US005222258A

United States Patent [19]

Mucci et al.

[11] Patent Number: 5,222,258

[45] Date of Patent: Jun. 29, 1993

[54] HOSPITAL GARMENT WITH QUICK RELEASE MECHANISM

[76] Inventors: Joanne Mucci, 6113 Will Plyler Rd., Waxhaw, N.C. 28173; George Spector, 233 Broadway, Rm. 702, New York, N.Y. 10279

[21] Appl. No.: 894,995

[22] Filed: Jun. 8, 1992

[51] Int. Cl.[5] ..... A41D 13/00

[52] U.S. Cl. ..... 2/114; 2/101; 2/79; 2/217; 2/DIG. 7; 24/306

[58] Field of Search ..... 2/1, 2, 8, 67, 69, 75, 2/79, 80, 85, 86, 69.5, 94, 96, 108, 101, 104, 105, 106, 114, 217, 218, 227, 251; 24/306; 602/62, 64, 78; 604/179

[56] References Cited

U.S. PATENT DOCUMENTS

| | | | |
|---|---|---|---|
| 459,106 | 8/1891 | Fifield | 2/114 |
| 1,233,156 | 7/1917 | Zies | 2/114 |
| 2,127,763 | 8/1938 | Bentz | 2/85 |
| 2,578,135 | 12/1951 | Hoigaard et al. | 2/275 |
| 3,112,491 | 12/1963 | Cleveland | 2/96 X |
| 3,116,491 | 1/1964 | Previdi et al. | 2/106 |
| 3,196,459 | 7/1965 | Grazia | 2/96 |
| 3,394,437 | 7/1968 | Sinclair | 2/96 |
| 3,800,330 | 4/1974 | Bowcut | 2/227 |
| 4,117,609 | 10/1978 | Helt | 2/227 |
| 4,258,440 | 3/1981 | McGowan | 2/227 |
| 4,570,268 | 2/1986 | Freeman | 2/114 |
| 4,638,509 | 1/1987 | Charron | 2/227 |
| 4,651,353 | 3/1987 | Walden | 2/227 |
| 4,737,995 | 4/1988 | Wiley | 2/114 |
| 4,914,756 | 4/1990 | Grassick | 2/DIG. 6 |
| 4,975,984 | 12/1990 | Sting | 2/105 X |
| 5,062,159 | 11/1991 | Jakub | 2/105 X |
| 5,097,536 | 3/1992 | Cohen | 2/DIG. 7 |
| 5,133,086 | 7/1992 | Truitt et al. | 2/105 X |

FOREIGN PATENT DOCUMENTS

| | | | |
|---|---|---|---|
| 723921 | 4/1932 | France | 2/227 |
| 1431107 | 1/1966 | France | 2/227 |
| 2543802 | 10/1984 | France | 2/DIG. 7 |
| 1556643 | 4/1990 | U.S.S.R. | 2/227 |
| 2027330 | 2/1980 | United Kingdom | 2/227 |

*Primary Examiner*—Clifford D. Crowder
*Assistant Examiner*—Jeanette E. Chapman

[57] ABSTRACT

An improved medical garment is provided which consists of a flexible fabric shell for enveloping a portion of a body and two limbs of a patient. The flexible fabric shell has a first overlapping openable seam on the front covering the portion of the body, a second overlapping openable seam on a first side covering the first limb and a third overlapping openable seam on a second side covering the second limb. A first structure is for releasably fastening the first overlapping openable seam, so that the flexible fabric shell can be put on and taken off the body of the patient. A second structure is for releasably fastening the second overlapping openable seam for a quick easy access to the first limb. A third structure is for releasably fastening the third overlapping openable seam for a quick easy access to the second limb.

1 Claim, 1 Drawing Sheet

HOSPITAL GARMENT WITH QUICK RELEASE MECHANISM

BACKGROUND OF THE INVENTION

The instant invention relates generally to hospital gowns and more specifically it relates to an improved medical garment which provides for a quick easy access to injured and IV locations on a patient.

There are available various conventional hospital gowns which do not provide the novel improvements of the invention herein disclosed.

SUMMARY OF THE INVENTION

A primary object of the present invention is to provide an improved medical garment that will overcome the shortcomings of the prior art devices.

Another object is to provide an improved medical garment that is structured to allow for a quick easy access to injured locations and IV locations on a patient.

An additional object is to provide an improved medical garment that contains a quick release mechanism for rapidly opening the garment.

A further object is to provide an improved medical garment that is simple and easy to use.

A still further object is to provide an improved medical garment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
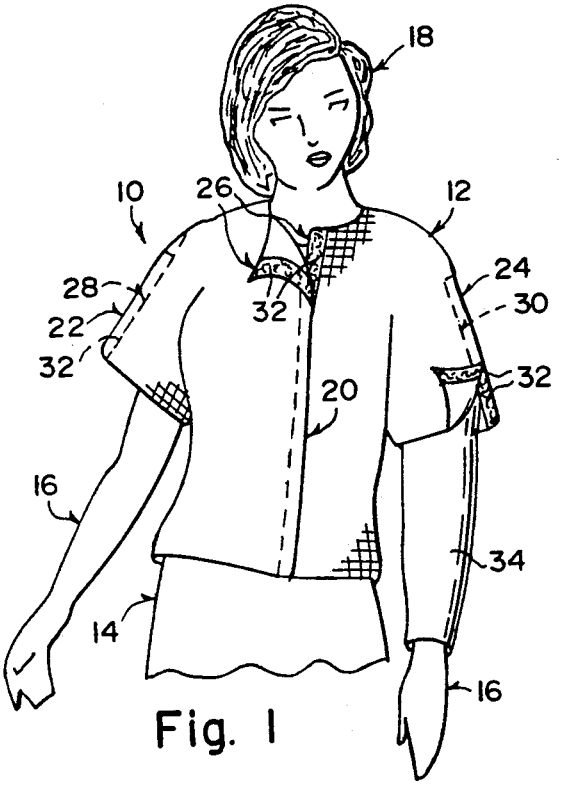
FIG. 1 is a front view of the garment of the present invention as a shirt worn on a patient with a cast on an arm.

Turning now descriptively to the drawings, in which similar reference characters denote similar elements throughout the several views, the Figures illustrate an improved medical garment 10, which consists of a flexible fabric shell 12 for enveloping a portion of a body 14 and two limbs 16 of a patient 18. The flexible fabric shell 12 has a first overlapping openable seam 20 on the front covering the portion of the body 14, a second overlapping openable seam 22 on a first side covering the first limb 16 and a third overlapping openable seam 24 on a second side covering the second limb 16. A first structure 26 is for releasably fastening the first overlapping openable seam 20, so that the flexible fabric shell 12 can be put on and taken off the body 14 of the patient 18. A second structure 28 for releasably fastening the second overlapping openable seam 22 for a quick easy access to the first limb 16. A third structure 30 is for releasably fastening the third overlapping openable seam 24 for a quick easy access to the second limb 16.

Figure 2:
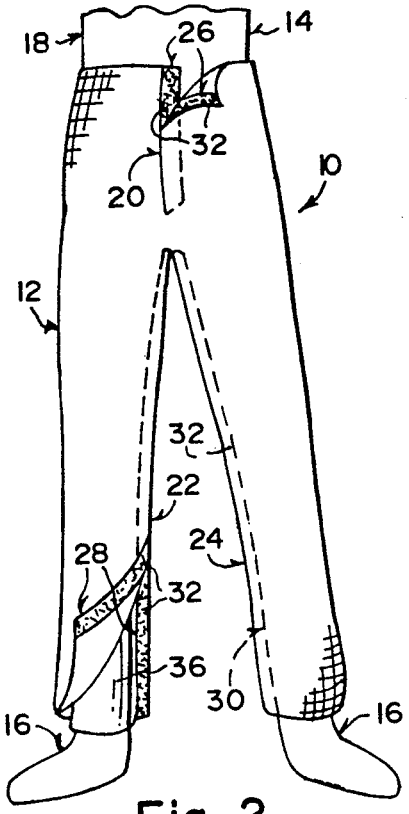
FIG. 2 is a front view of the garment of the present invention as a pair of pants worn on a patient with a cast on a leg.

The first, second and third releasably fastening structures 26, 28 and 30 are each hook and loop closure members 32. The flexible fabric shell 12 as in FIG. 1 is a shirt for covering the upper body and the arms of the patient 18 with at least one arm having a cast 34. The flexible fabric shell 12 as in FIG. 2 is a pair of pants for covering the lower body and the legs of the patient 18 with at least one leg having a cast 36.

Figure 3:
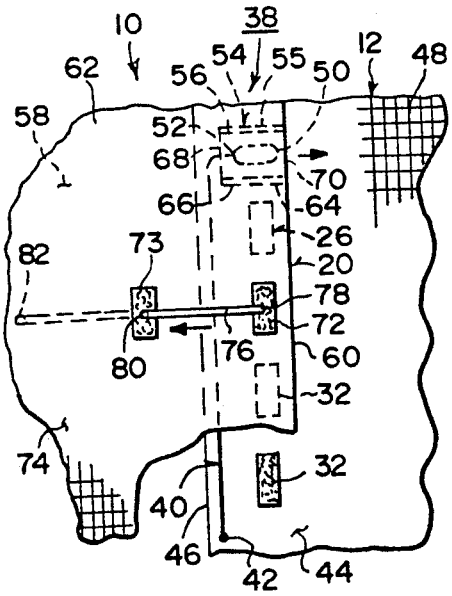
FIG. 3 is a front view of a portion of the garment showing a quick release mechanism for opening the garment.
Figure 4:
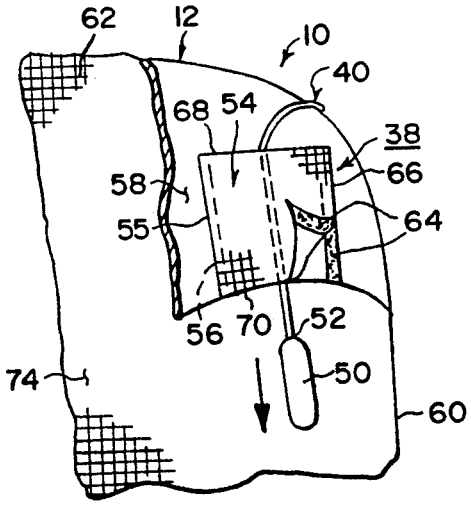
FIG. 4 is an enlarged front view of a portion of the garment showing the pocket for holding the pull tab in greater detail.

The improved medical garment 10, as shown in FIGS. 3 and 4 further can contain a quick release mechanism 38 for rapidly opening the hook and loop closure members 32 in the first releasably fastening structure 26. The quick release mechanism 38 includes an elongated cord 40 affixed at a first end 42 to a lower front surface 44 at an edge 46 of a first side 48 of the first overlapping openable seam 20. A pull tab is affixed to a second end 52 of the elongated cord 40. A pocket 54 is affixed at its upper end 55 by stitching 56 to an upper rear surface 58 at an edge 60 of a second side 62 of the first overlapping openable seam 20. Hook and loop closure strips 64 are at a lower end 66 of the pocket 54, with the side ends 68, 70 of the pocket 54 being open allowing the pull tab 50 to be inserted therein. The pull tab 50 can be pulled out and downwardly from the pocket 54, so that the cord 40 can separate the hook and loop closure strip 64 in the pocket 54 and the hook and loop closure member 32 in the first releasably fastening structure 26. Hook and loop closure tabs 72, 73 are in a spaced apart side by side relationship on a front surface 74 at the edge 60 of the second side 62 of the first overlapping operable seam 20. An elastic band 76 is affixed at a first end 78 to the first hook and loop closure tab 72 closest to the edge 60 of the second side 62 of the first overlapping operable seam 20, then extends through the second hook and loop closure tab 73 at 80 and then affixed at a second end 82 to the rear surface 58 of the second side 62 of the first overlapping openable seam 20. When the first overlapping openable seam 20 is opened, the elastic band 76 will pull the hook and loop closure tabs 72, 73 towards each other to engage. It is to be noted that the garment does not use metal and can be worn when taking X-ray or other electronic scans.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved medical garment which comprises:

a) a flexible fabric shell for enveloping a body portion, first and second limbs of a patient, said flexible fabric shell having a first overlapping openable seam on the front, covering said body portion, a second overlapping openable seam on a first side covering said first limb and a third overlapping openable seam on a second side covering said second limb;

b) a first means for releasably fastening said first overlapping openable seam, so that said flexible fabric shell can be put on and taken off said body portion;

c) a second means for releasably fastening the second overlapping openable seam for a quick easy access to said first limb; and d) a third means for releasably fastening the third overlapping openable seam for a quick easy access to said second limb; wherein said first, second and third releasably fastening means are each hook and loop closure members; further comprising a quick release mechanism for rapidly opening said hook and loop closure members in said first releasably fastening means, said quick release mechanism including:

e) an elongated cord affixed at a first end to a lower surface from an edge of a first side of the first overlapping openable seam;

f) a pull tab affixed to a second end of said elongated cord;

g) a pocket with side ends affixed at its upper end by stitching to an upper rear surface at an edge of a second side of the first overlapping openable seam;

h) hook and loop closure strips at a lower end of said pocket, with said side ends of said pocket being open allowing said pull tab to be inserted therein, said pull tab can be pulled out and downwardly from said pocket, so that said cord can separate said hook and loop closure strips in said pocket and said hook and loop closure member in said first releasably fastening means;

i) hook and loop closure tabs in a spaced apart side by side relationship on a front surface at the edge of the second side of the first overlapping openable seam; and j) an elastic band affixed at a first end to a first hook and loop closure tab closest to the edge of the second side of the first overlapping openable seam, then extending through a second hook and loop closure tab and then affixed at a second end to the rear surface of the second side of the overlapping openable seam, so that when the first overlapping openable seam is opened, said elastic band will pull said hook and loop closure tabs towards each other to engage.

* * * * *